US006357635B1

(12) United States Patent
Pagliaro et al.

(10) Patent No.: US 6,357,635 B1
(45) Date of Patent: Mar. 19, 2002

(54) DISPENSING CLOSURE ASSEMBLY

(75) Inventors: Joseph B. Pagliaro, North Brunswick, NJ (US); Brian R. Vakiener, Rocky Hill, CT (US)

(73) Assignee: Loctite Corporation, Rocky Hill, CT (US)

( * ) Notice: Subject to any disclaimer, the term of this patent is extended or adjusted under 35 U.S.C. 154(b) by 0 days.

(21) Appl. No.: 09/787,068

(22) PCT Filed: Sep. 15, 1999

(86) PCT No.: PCT/US99/20953

§ 371 Date: Mar. 12, 2001

§ 102(e) Date: Mar. 12, 2001

(87) PCT Pub. No.: WO00/15540

PCT Pub. Date: Mar. 23, 2000

(51) Int. Cl.[7] ..... B67D 5/00

(52) U.S. Cl. ..... 222/525; 222/541.6

(58) Field of Search ..... 222/525, 541.6

(56) References Cited

U.S. PATENT DOCUMENTS

| | | | | |
|---|---|---|---|---|
| 3,120,910 A | * | 2/1964 | Nyden | 222/525 |
| 4,408,700 A | * | 10/1983 | Fillmore et al. | 222/525 |
| 4,754,899 A | | 7/1988 | Stull | |
| 4,927,065 A | | 5/1990 | Beck | |
| 4,967,941 A | | 11/1990 | Beck | |
| 5,501,377 A | | 3/1996 | Dubach | |

* cited by examiner

*Primary Examiner*—Philippe Derakshani
(74) *Attorney, Agent, or Firm*—Hoffmann & Baron, LLP

(57) ABSTRACT

A dispensing closure assembly positionable over an open end of a container includes a cap attachable to the end of the container and having a sealable opening in fluid communication with the contents of the container.

17 Claims, 6 Drawing Sheets

DISPENSING CLOSURE ASSEMBLY

BACKGROUND OF THE INVENTION

1. Field of the Invention

The present invention relates to a dispensing closure assembly for liquids of various viscosity. More specifically, the present invention is directed to a single dispensing closure assembly for precisely dispensing anaerobic adhesives and sealants of various viscosities.

2. Description of the Related Art

Various designs for fluid dispensing closure assemblies are known which dispense the contents of a container over which the dispensing closure assembly is placed. Additionally, these closure assemblies provide for sealing the container between usages. These dispensing closure assemblies generally include a stationary cap which is attachable to the container of fluid and a cover which is movable with respect to the cap so as to open a dispensement passageway through the assembly and thereby place the contents of the container in fluid communication with a dispense opening in the cover so that the fluid may be dispensed. Such dispensing closure assemblies may be either twisted open and closed or pushed-pulled open and closed so as to effect the relative movement of the cap and cover. Many known dispensing closure assemblies also permit relative movement of the cap and the cover so as to vary the dispense opening so as to increase or decrease the flow rate of the dispensed fluid.

In addition to accounting for viscosity considerations, the nature of the fluid to be dispensed should also be considered. For example, since certain adhesives, such as cyanoacrylates, cure in presence of moisture, while others, such as anaerobics, cure in the absence of oxygen, the dispenser should be designed with the ability to accommodate the particular requirements of the adhesive to be dispensed while also providing a convenient method of selecting an appropriate and versatile means for doing so.

Anaerobic adhesives are characterized by curing in the absence of oxygen through contact with active metals, such as iron and copper. Many of the existing dispensing closure assemblies for anaerobic adhesives allow active metal contaminants thereinto through the dispense opening during the course of dispensing the adhesive. These contaminants have the deleterious effect of accelerating the curing mechanism in adhesive still contained within the dispense passageway which results in eventual blockage of the dispensing closure assembly. Once this occurs an operator usually cuts such dispense assemblies proximal to the cured blockage in order to again allow for dispensing of the adhesive from the container. Cutting a dispensing closure assembly, however, may result in a differently-sized dispense orifice and thereby significantly change the dispense characteristics for the assembly. The drawback of contaminants into the dispensing closure assembly can be minimized by tailoring the size of the dispense orifice to the viscosity of the fluid being dispensed so as to provide for precise metering of the fluid therethrough. These problems are multiplied when the dispenser is involved in assembly-line operations such as in the automotive or electronics industries.

Adhesives as a general class of fluids useful in the present invention, however, exhibit a wide variety of viscosities, ranging from a fluid being less viscous than water to a flowable paste. The actual rheology of the adhesive used will depend on the intended application. Dispense assemblies having only a single-size dispense orifice may precisely dispense a bead of adhesive when the viscosity of the adhesive is suited to the geometry of the dispense orifice provided. If the same dispensing closure assembly is used for a different adhesive, however, the geometry of the dispense orifice may neither adequately contain adhesives having a lower viscosity nor adequately dispense adhesives having a higher viscosity. Additionally, it is generally desirable to provide a dispensing closure assembly which may accommodate a range of fluid viscosities so as to reduce the manufacturing costs of producing unique dispensing closure assemblies for fluids of narrow ranges of viscosities.

Towards this end, known dispensers have often attempted to accommodate a wide range of viscosities by providing dispensing closure assemblies having a range of selectably-sized dispense openings at the dispense tip. One such example is shown in U.S. Pat. No. 5,501,377, where a dispensing closure assembly includes a central cylindrical sealing post which is variably positionable within a conical or tapering cover wall so as to provide a full range of dispense opening areas at the dispense orifice. For a fluid of a given viscosity, precise dispensement thereof through a series of assembly closures and openings is suspect due to the fully variable cross-sectional area which may be provided at the dispense orifice. That is, the user is unlikely to precisely select an appropriate dispense opening area each time the dispensing closure assembly is opened.

Another example is shown in U.S. Pat. No. 4,927,065, which provides a dispense orifice of discretely changing dispense orifice sizes by positioning a central sealing post having a series of steps formed at its distal end within a cover having a cylindrical dispense aperture. From a closed position where the post extends through the dispense orifice, the post is withdrawn through the cover so as to place different-size steps within the dispense orifice to vary the geometric configuration at the dispense orifice. While providing a more repeatable variation in the dispense orifice, such a design may not be suitable for dispensing anaerobic fluids due to the contamination risk from the post extending out from the cover in the open position. The post is likely to contact the surface to which the adhesive is being applied and to collect particles of that surface which may, in turn, cure the adhesive on the post. For example, particles of brass or other active metals that collect on the post can cause the adhesive thereon to cure very quickly. Adhesive curing on the steps of the post will chance the diameter of the post at that location, and thereby affect the dispensing characteristics of the dispensing closure assembly. Furthermore, as the post is exposed during application of the adhesive, the post is more susceptible to being bent or damaged. This too prevents precise dispensement of a fluid. And, from a manufacturing standpoint, it is often times difficult to mold a thin post having a complex geometry at its distal end due to the manner by which such molds accept the moldable plastic and by which the post is withdrawn from the mold in a direction towards its proximal end.

In addition, such designs may not be suitable in many applications because in the course of accommodating a wide range of viscosities, the user is left with more options than may be desirable for day-to-day applications in which precise metering of an adhesive is of paramount importance. For example, when a dispensing closure assembly allows a user to select between three dispense opening sizes depending upon the type of fluid to be dispensed, each time the user opens the dispensing closure assembly there is a risk that the user may incorrectly select an incompatibly-sized dispense opening. Should the user select too large a dispense opening for a low viscosity fluid, far too much fluid may be dispensed onto a high cost component which must then be either cleaned or discarded. The likelihood of the user selecting an incompatibly-sized dispense opening is higher still in manufacturing environments where the operator opens and closes the dispensing closure assembly many times during the course of use.

It is therefore desirable to provide a dispensing closure assembly able to accommodate a variety of fluid viscosities which is also dedicatable to a particular fluid viscosity so as to require only a binary on-off adjustment by the user prior to each use.

SUMMARY OF THE INVENTION

The inventive dispensing closure assembly is positionable over an open end of a container. The dispensing closure assembly includes a cap attachable to the open end of the container and having a sealable opening in fluid communication with the contents within the container and an elongate hollow cover slidably movable with respect to the cap from a closed position restricting passage of the contents through the sealable opening of the cap to an open position permitting passage of the contents through the sealable opening of the cap. The cover includes a dispense end providing an annular cover surface defining a dispense opening of a first diameter for either direct dispensement of fluid therethrough or mating fluid communication with a luer cannula having a dispense opening of a second diameter smaller than the first diameter. The dispense end further defines an annular mitre channel spaced from the annular cover surface for providing a location at which the cover may be severed to define a dispense opening having a third diameter larger than the first diameter for direct dispensement of the contents.

The cover desirably includes a frangible tip in registry with the dispense opening for sealing the cover prior to first dispensing the fluid. The dispensing closure assembly is also contemplated as being provided in kit form with a luer slip cannula for positioning over the free end of the cover.

The present invention also discloses a method of dispensing a fluid, comprising the steps of providing a dispensing closure assembly to an open end of a container of fluid, where the dispensing closure assembly includes a plurality of dedicatable dispense openings and a binary on-off adjustment by the user prior to each use for providing fluid communication between the container and one of the dedicatable dispense openings. The method also includes the steps of selecting one of the plurality of dedicatable dispense openings for dispensing the fluid therethrough and adjusting the dispensing closure assembly to one of an open position so as to establish fluid communication between the container and the dispense opening and a closed position so as to prevent fluid communication between the container and the dispense opening subsequent to the selecting step. The selecting step further allows a user to select dispensement through a first dispense opening defined by the assembly, through a second dispense opening defined by a luer-slip cannula positioned over one end of the assembly, and a third dispense opening defined by cutting the assembly at a mitre channel formed in the assembly. The second dispense opening being smaller than the first dispense opening and the third dispense opening being larger than the first dispense opening.

The present invention recognizes that requiring a user to select a properly-sized dispense opening each time a dispensing closure assembly is opened tends to only lessen quality control of the precision with which the fluid may be metered. As the optimum or most desirable dispense opening area is a function of the particular fluid to be dispensed and the particular use to which it is directed, the desired dispense opening area is effectively determined once the dispensing closure assembly is mated to a container of a particular fluid. The present invention has particular applicability for use on a variety of adhesive compositions having different viscosities, curing mechanisms and uses. Among the more desired adhesives contemplated for use with the present invention are anaerobic adhesives, cyanoacrylate adhesives, silicone adhesives, polyurethane adhesives and combinations and copolymers thereof Other fluids are of course also contemplated.

The present invention will be more readily appreciated in a reading of the "Detailed Description of the Inventions" with reference to the following drawings.

DETAILED DESCRIPTION OF THE INVENTION

Figure 1:
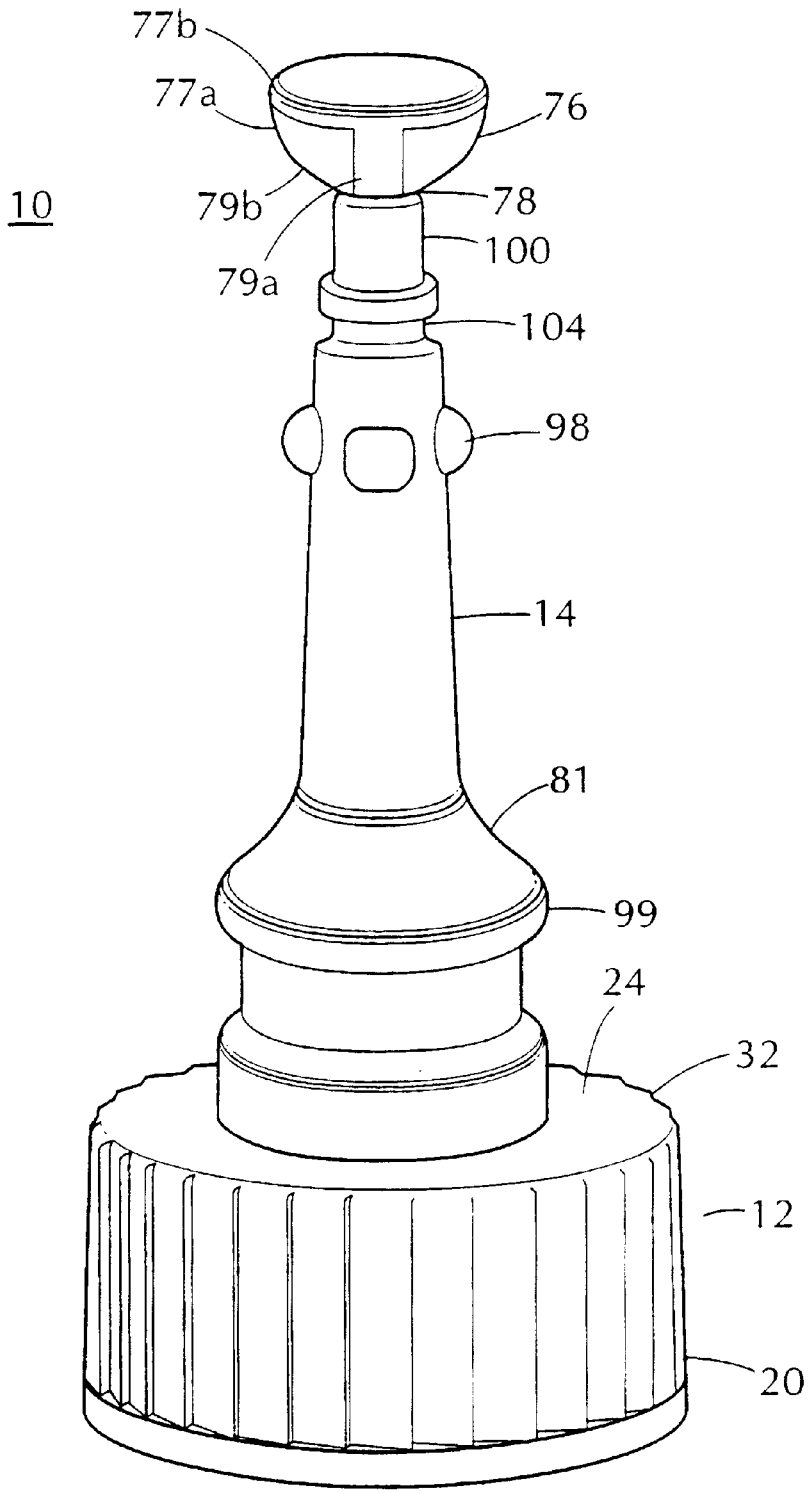
FIG. 1 shows a perspective view of the dispensing closure assembly of the present invention.

Referring to FIG. 1, the present invention provides a dispense closure assembly 10 for dispensing a fluid such as an anaerobic adhesive. Dispense closure assembly 10 includes a cap 12 and a cover 14. Each of cap 12 and cover 14 may be formed of a suitable plastic by conventional manufacturing techniques. For example, cap 12 is desirably formed from high density polyethylene and cover 14 is desirably formed of a softer plastic such as polypropylene and the like. The material selected for both cap 12 and cover 14 should be breathable in that air may pass therethrough and inhibit premature curing of the fluid within assembly 10. Cover 14 is longitudinally movable with respect to cap 12 from a closed position blocking fluid flow through cover 14 to an open position allowing precise fluid metering through cover 14. In the present illustrative embodiment, dispensing closure 10 employs a push-pull arrangement to effect the relative longitudinal movement of cover 14 with respect to cap 12 between the open and closed positions, as will be described further hereinbelow.

Assembly 10 may dispense fluids having a viscosity anywhere in the range of 10 centipoise (cps) to 8,000 cps requiring no more than lightly compressing a flexible portion of the container (not shown) to which it is attached. Assembly 10 provides for the user to select from up to three possible sizes for a dispense opening through which the fluid is dispensed through cover 14 to a work surface. The selection of the proper dispense opening size is determined according to the viscosity of the fluid to be dispensed. The user need only make the selection prior to dispensing the contents of the container for the first time. The user may thereby dedicate dispensing closure assembly 10 to provide a dispense opening particularly suited to the fluid viscosity of the contents of the container. Once so dedicated, the user need only open and close dispensing closure assembly 10 prior to and after each use. The selection of the proper dispense opening size will be described in further detail hereinbelow.

Figure 2A:
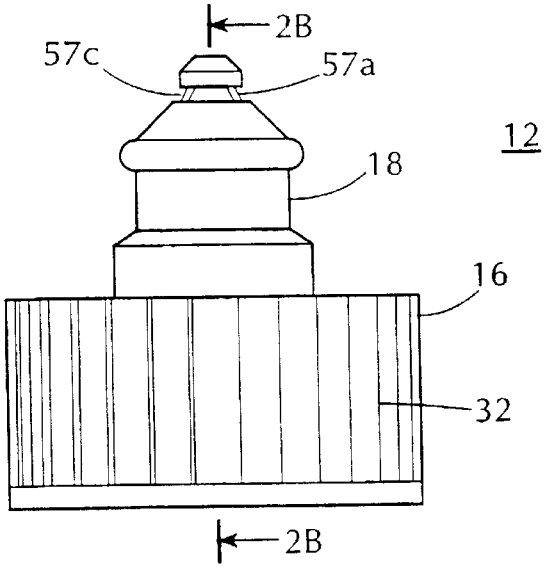
FIG. 2A is a side elevational view of the cap of the dispensing closure assembly of FIG. 1.
Figure 2B:
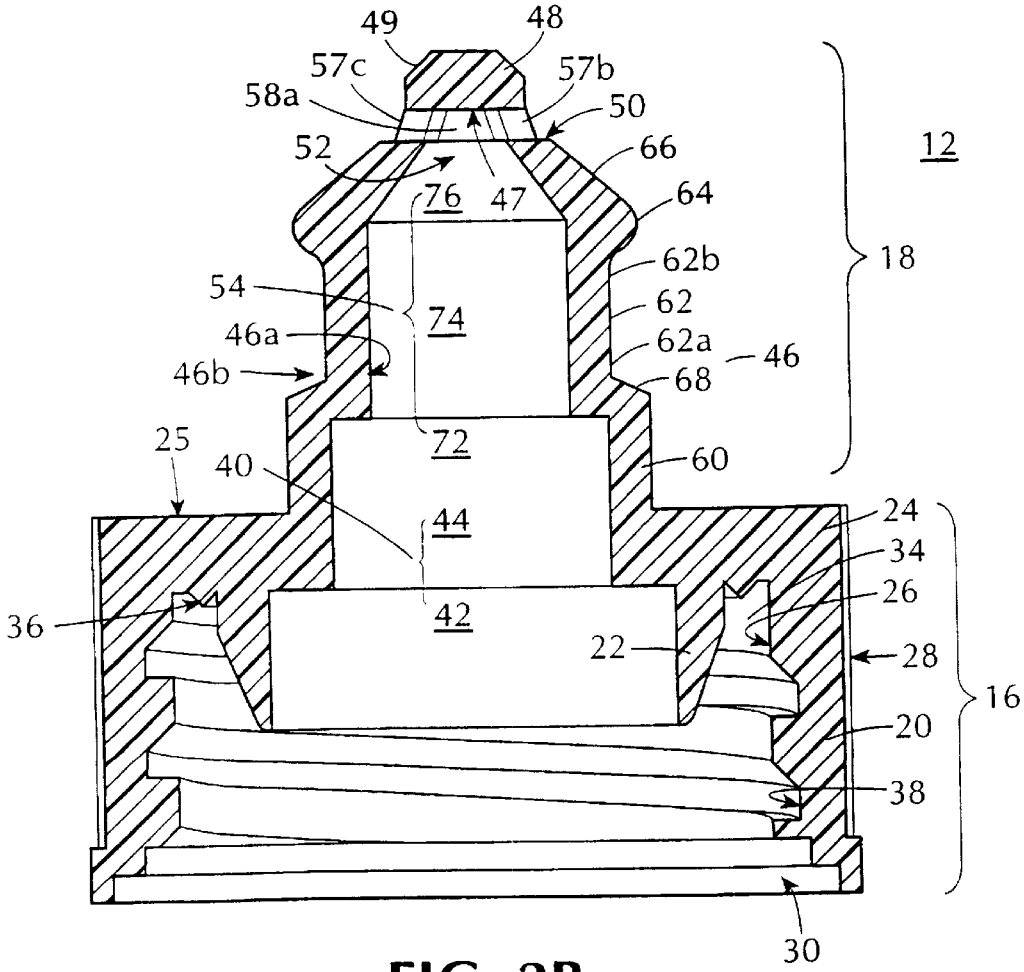
FIG. 2B is a cross-sectional view of the cap of the dispensing closure assembly of FIG. 1.

Referring now to FIGS. 2A and 2B, cap 12 includes a base portion 16 and an elongate dispense valve portion 18. Base portion 16 includes an elongate cylindrical outer wall 20 and an elongate cylindrical inner wall 22 coaxial with and radially inward with respect to outer wall 20. A generally planar transverse support wall 24 spans across a distal extent of first cylindrical wall 20 and second cylindrical wall 22 and supports dispense valve portion 18. Outer wall 20 includes an interior surface 26, an exterior surface 28 and defines a cap opening 30 opposite transverse support wall 24. Exterior surface 28 has formed thereon a plurality of circumferentially-spaced longitudinal gripping ribs 32 so as to assist manual gripping of cap 12 during both threading attachment with the adhesive container and longitudinally moving cover 14 with respect thereto. Base portion 16 of cap 12 further defines a proximal cap passageway 40 having a first portion 42 defined by inner wall 22 and a second portion 44 defined by transverse support wall 24 in coaxial alignment with first portion 42. Proximal cap passageway 40 is in fluid communication with the interior of the container of adhesive fluid and forms the first stage of the fluid flowpath for dispensing fluid within the container through dispensing closure assembly 10.

Interior surface 26 and inner wall 22 define an annular container receiving cavity 34 therebetween for fluid-tight engagement with a male connecting portion of the container of flowable anaerobic adhesive. Transverse support wall 24 desirably includes a depending annular sealing tooth 36 for enhanced sealing engagement with the annular rim of the male connecting portion of the container. Interior surface 26 has formed thereon a helical thread 38 so as to provide a threaded connection with the container.

Dispense valve portion 18 extends from transverse support wall 24 in registry with proximal cap passageway 40. Dispense valve portion 18 includes a tubular conduit wall 46 and a coaxially-located cylindrical hub 48. Conduit wall 46 terminates at a planar valve seat 50 which defines a cap dispense aperture 52. Conduit wall 46 includes an interior conduit surface 46*a* and an exterior conduit surface 46*b*. Interior conduit surface 46*a* further defines a distal cap passageway 54 communicating between proximal cap passageway 40 and cap dispense aperture 52. Hub 48 is positioned in spaced registry with cap dispense aperture 52 and includes a planar lower hub surface 47 in registry with dispense aperture and an upstanding cylindrical hub surface 49 coaxial therewith. Hub 48 is connected to conduit wall 46 by three leg extents 57*a–c* extending from hub surface 47 to a location on interior conduit surface 46*a* adjacent planar valve seat 50. Leg extents 57*a–c* are spaced so as to define three sealable openings 58*a–c* in fluid communication with cap dispense aperture 52.

Exterior conduit surface 46*b* includes a first elongate cylindrical surface 60, a second recessed elongate cylindrical surface 62, an annular stop bead 64, and a tapered annular skirt 66. First cylindrical surface 60 is contiguous with second cylindrical surface 62 across an annular tapered rim 68. Second cylindrical surface 66 is therefore bounded at a proximal end 66*a* by tapered rim 68 and at a distal end 66*b* by stop bead 64. Tapered rim 68 and stop bead 64 provide for the relative longitudinal positioning of cap 12 and cover 14 in the closed and open positions as will be described hereinbelow. For manufacturing purposes, interior conduit surface 46*a* generally follows the contour of exterior conduit surface 46*b* at cylindrical surfaces 60 and 62.

Figure 3:
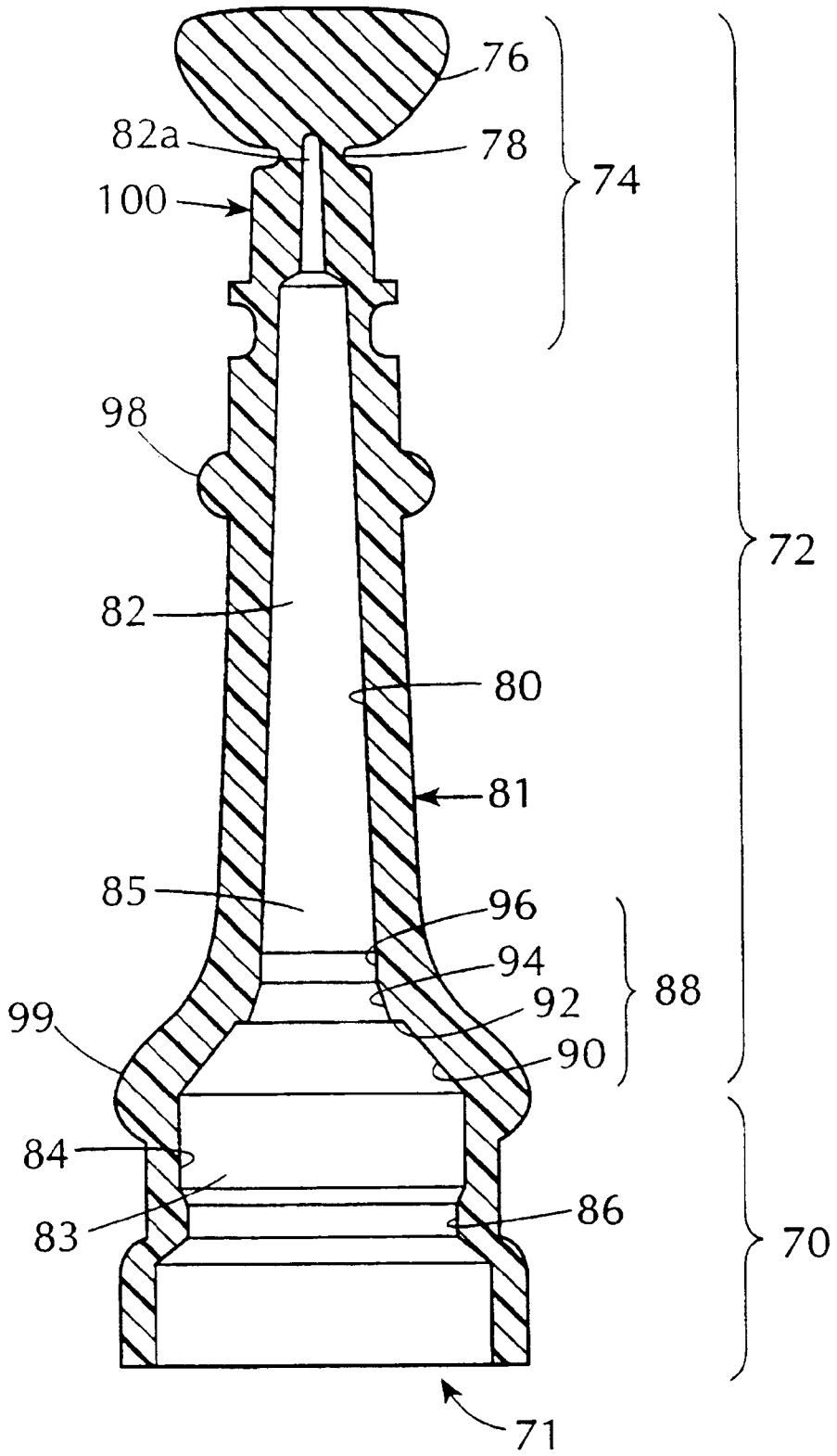
FIG. 3 shows a cross-sectional view of the cover of the dispensing closure assembly of FIG. 1.
Figure 4:
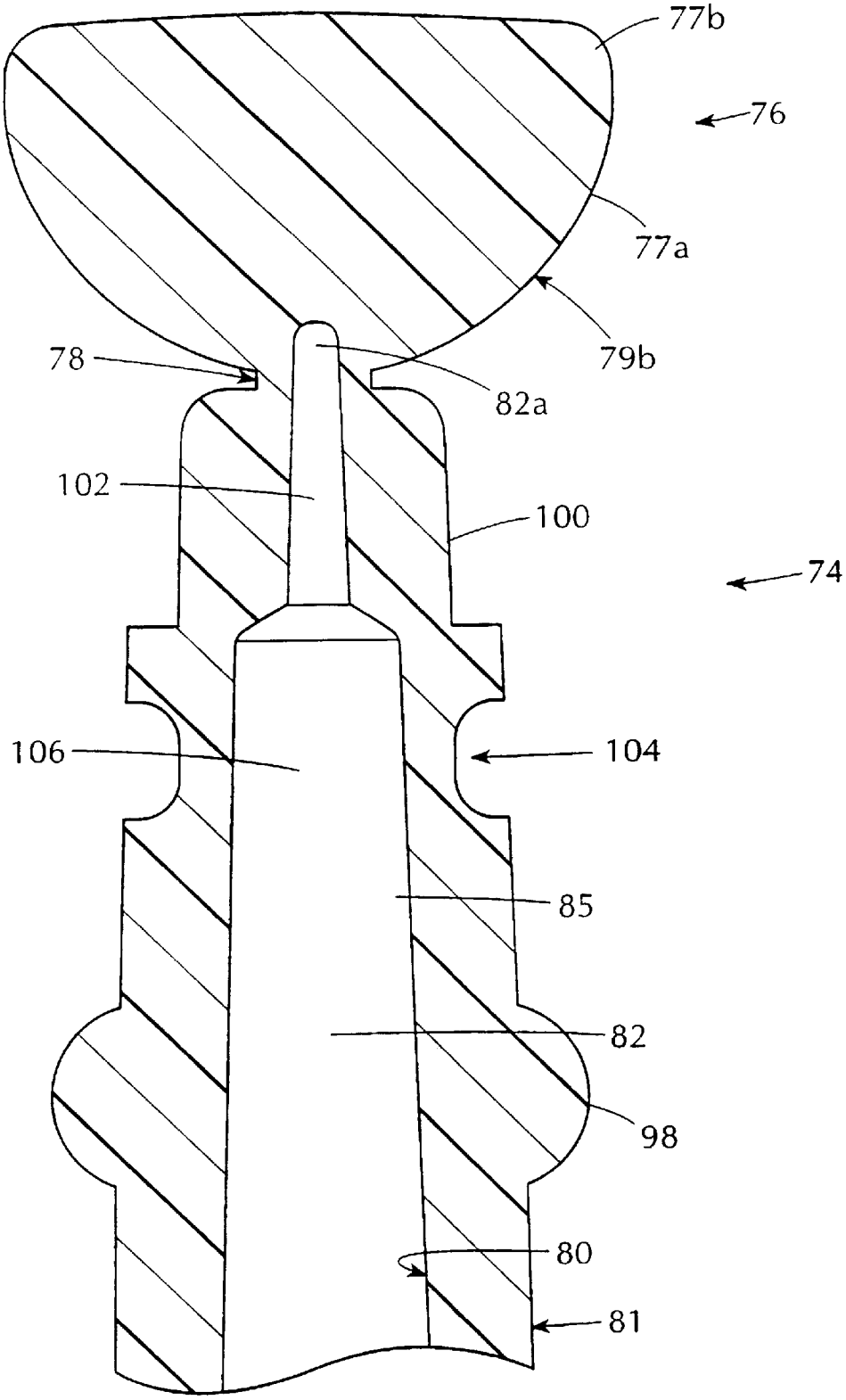
FIG. 4 shows a cross-sectional view of the dispensing tip of the present invention.

Referring now to FIGS. 1, 3, and 4, cover 14 is an elongate hollow member and includes an elongate hollow mechanical working portion 70 and an elongate hollow fluid conduit portion 72. Fluid conduit portion 72 further includes a dispensing end 74 originally provided having a removable tip 76 attached thereto across a frangible neck 78. Cover 14 includes an interior cover surface 80 and an exterior cover surface 81. Interior cover surface 80 defines a cover interior 82 which includes a mechanical working space 83 defined by mechanical working portion 70 and a dispensing passageway 85 defined by fluid conduit portion 72.

Mechanical working portion 70 of cover 14 defines a proximal cover opening 71 for receiving dispensing valve portion 18 of cap 12 therethrough. Mechanical working portion 70 further includes elements for cooperating with stop bead 64 and tapered rim 68 of cap 12 so as to define the closed and open configurations of dispensing closure 10. Interior cover surface 80 includes an elongate cylindrical cover bushing surface 84 supporting an annular cover positioning rib 86 at one end thereof. With additional reference to FIGS. 5 and 6, the relative alignment of cover positioning rib 86 along second cylindrical surface 62 of cap 12 provides the closed and open positions for the dispense closure assembly 10. As cover 14 is moved between and open and closed position, annular stop bead 64 of cap 12 provides wiping sliding engagement with cover bushing surface 84 so as to prevent any fluid from passing therebetween.

Figure 5:
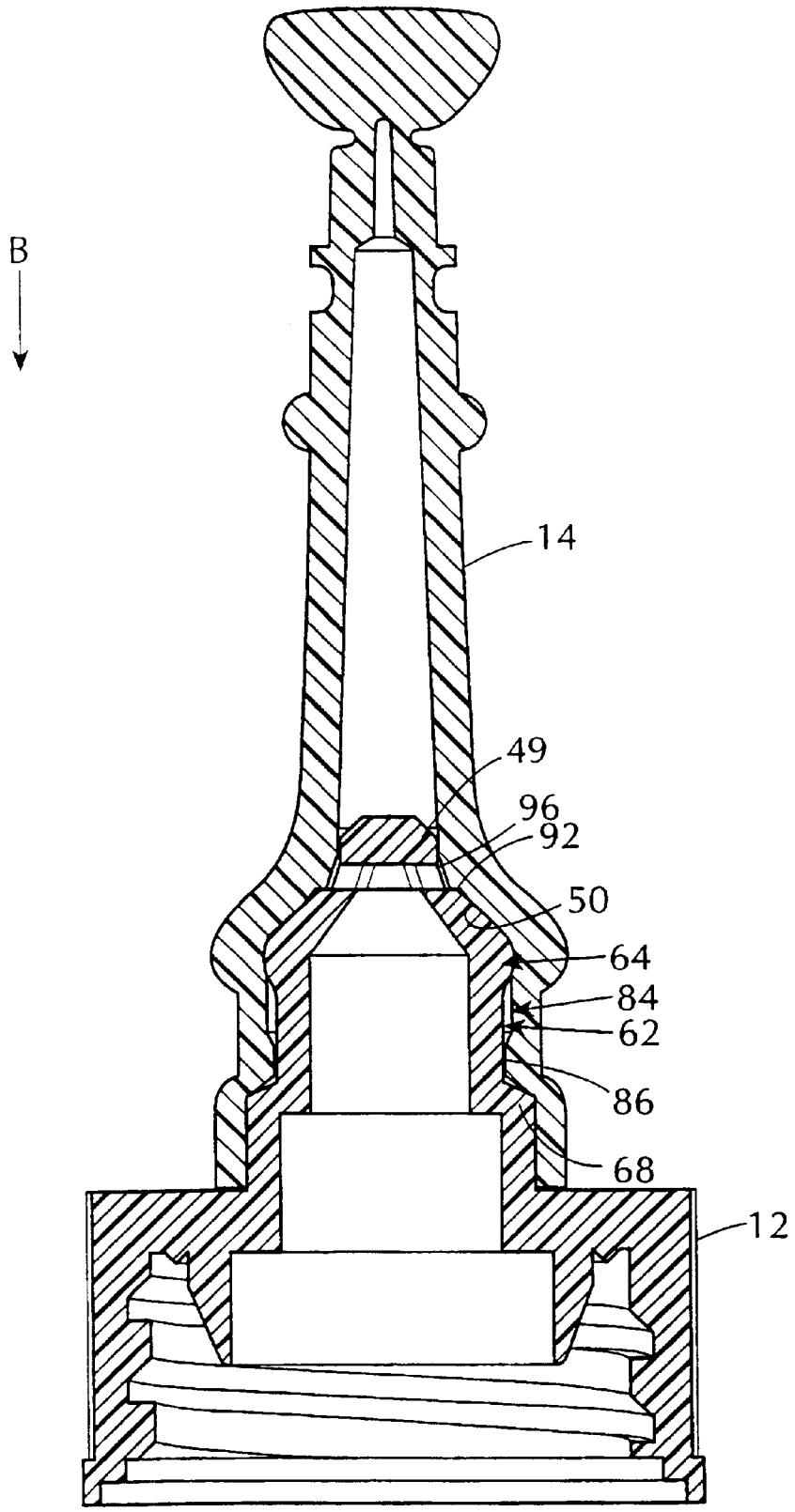
FIG. 5 shows a cross-sectional view of the dispensing closure assembly of FIG. 1 in the closed configuration.
Figure 6:
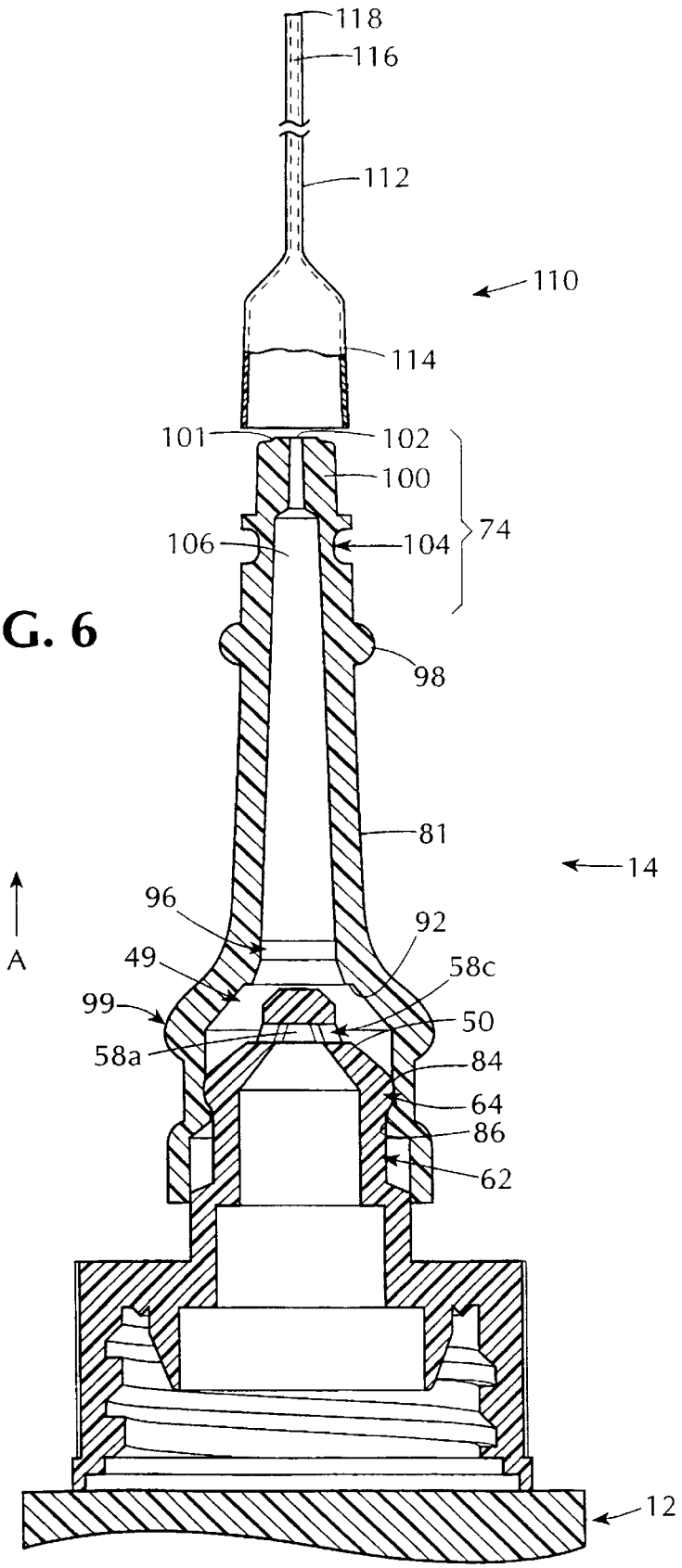
FIG. 6 shows a cross-sectional view of the dispensing closure assembly of FIG. 1 in an open configuration.

Referring now to FIGS. 3, 5, and 6, fluid conduit portion 72 of cover 14 includes a valve section 88 defined by the geometry of interior cover surface 80 about sealable openings 58*a–c* of cap 12. Valve section 88 is a contiguous stretch of interior cover surface 80 including an annular tapered surface 90, a planar seating surface 92, a flared passageway extent surface 94, and a cylindrical hub-sealing surface 96. Surfaces 90, 92, 94, and 96 are formed to be coaxial with dispensing passageway 85. As shown in FIG. 5, when dispensing closure assembly 10 is in the closed configuration, cover 14 provides sealing engagement with cap 12 so as to prevent fluid communication between sealable openings 58*a–c* and both ends of cover 14. In the closed configuration a primary seal is established where planar seating, surface 92 sealingly engages planar valve seat 50 and a secondary seal is established where hub-sealing surface 96 sealingly engages cylindrical hub surface 49. As further shown in FIG. 5, a third sealing engagement is provided where stop bead 64 of cap 12 sealingly engages cover bushing surface 84 so as to provide a third sealing engagement between cap 12 and cover 14 below sealable openings 58*a–c*. The primary seal prevents fluid flowing from sealable openings 58*a–c* towards dispensing end 74 while the secondary and third seals prevent liquid from flowing towards cover opening 71.

FIG. 6 shows dispensing closure assembly 10 in an open configuration whereby cover 14 is longitudinally moved in the direction of arrow A from cap 12. It is seen that in the open configuration that the primary and secondary seals are temporarily broken while the third seal provided between cover positioning rib 86 of cover 14 and stop bead 64 of cap 12 is maintained. As planar seating surface 92 and cylindrical hub sealing surface 96 no longer engage any part of cap 12, sealable openings 58*a–c* are placed in fluid communication with dispensing passageway 85.

With additional reference to FIG. 4, dispensing end 74 allows a user to select the size of a dispense orifice so as to provide for precise metering of the fluid therethrough. Frangible neck 78 is an annular member formed about a distal end 82*a* of cover interior 82 between a cylindrical tip 100 and removable tip 76. Removable tip 76 is desirably formed having a cross-shaped component 77*a* presenting a pair of intersecting arcuate lower surfaces 79*a* and 79*b* and supporting a disc-shaped upper component 77*b*. The cross-shape of component 77*a* is selected to minimize the amount of material required by removable tip 76 while the disc-shaped component 77*b* allows for hot runner molding of cover 14 at relatively faster cycling times. Removable tip 76 and frangible neck 78 are designed to expose a first dispensing port 102 defined by cylindrical tip 100 when removable tip 76 is either twisted or sheared from cover 14. The material selected for cover 14 should be sufficiently brittle so as to minimize the occurrence of flashing about first dispensing port 102. Flashing being any extraneous material or rough surface disposed about or occluding first dispensing port 102. By minimizing the occurrence of flashing the present invention also minimizes the likelihood of entrapping particles which may provoke curing of the anaerobic adhesive across or within dispensing passageway 85. Dispensing end 74 desirably provides an annular dispensing tip rim 101 about the proximal end of cylindrical tip 100.

Referring again to FIG. 6, first dispensing port 102 is formed having a diameter selected to provide precise metering of fluids of medium viscosities and adequate metering characteristics for fluids having low viscosities. In order to better accommodate low viscosity fluids, cylindrical tip 100 is formed having a diameter which accommodates a luer slip cannula assembly 110 thereover in frictional engagement. Luer slip cannula assembly 110 is well known in the medical arts for dispensing medicaments and includes an elongate cannula 112 and a luer adapter 114 at one end thereof. Cannula 112 defines an elongate cannula passageway 116 and a cannula dispense port 118 having a diameter smaller than that provided by first dispensing port 102. Cannula 112 thereby provides for even more precise metering of low viscosity fluids at cannula dispense port 118 than is provided by first dispensing port 102 at cylindrical tip 100.

The uniform cross-sectional shape of cylindrical tip 100 and the severing of removable tip 76 ensure reproducible and reliable dispensing closure assembly 10 compatibility with luer adapter 114 in that there is no risk of a user over-cutting the dispense tip or of the assembly. After separating removable tip 76 therefrom, a user would simply slide luer adapter 114 over cylindrical tip 100 until abutting annular dispensing tip rim 101. Luer slip cannula assembly 110 is also desirably formed from a breathable plastic material so as to inhibit premature curing of an anaerobic adhesive therein. The present invention further contemplates providing a luer slip cannula assembly 110 in kit form with dispensing closure assembly 110 for dispensing fluids having a low viscosity.

Dispensing closure assembly 10 also accommodates dispensement of fluids having a relatively high viscosity. Exterior cover surface 81 defines an annular mitre channel 104 adjacent cylindrical dispensing tip 100 for guiding a hand-held cutting device in severing cover 14 so as to expose a second dispensing port 106 having a diameter that is greater than the diameter of first dispensing port 102. Mitre channel 106 is formed about a portion of dispensing passageway 85 having a diameter larger than provided through cylindrical tip 100. Second dispensing port 108 is thereby better suited to accommodating and precisely metering fluids having a relatively high viscosity. Desirably, mitre channel 106 extends in substantially transverse coaxial alignment with dispensing passageway 85.

As the container to which dispensing assembly 10 is mounted will indicate the particular fluid contained therein, a user will know prior to dispensing the fluid just how large a dispense orifice is required for precise metering of the fluid. For low and medium viscosity fluids, the user may choose to simply separate removable tip 76 from cover 14 and proceed to dispense. Or, for low viscosity fluids the user may couple a luer slip cannula assembly over cylindrical tip 100 so as to dispense through a smaller dispense orifice. Alternatively, for relatively high viscosity fluids, the user may cut cover 14 at miter channel 106 so as to expose a larger dispense orifice. Once the initial dispense orifice decision is made, the user need only open and close dispensing closure assembly 10 with each use. The present invention is thereby able to accommodate fluids of a range of fluid viscosities while also minimizing the occurrence of the user improperly selecting the size of the dispense orifice and dispensing copious amounts of fluid onto a work surface.

A user may close dispensing closure assembly 10 by applying a longitudinal closing force in the direction of arrow B, shown in FIG. 5, to force positioning rib 86 of cover 14 back towards tapered rim 68 of cap 12 until the primary and secondary seals are re-established. Once again, during the relative longitudinal movement of cover 14 and cap 12, stop bead 64 of cap 12 continues to wipingly slide along cover bushing surface 84 to prevent fluid from passing therebetween into mechanical working space 83. Exterior surface 81 of cover 14 is formed having a generally smooth contour to accommodate a user opening and closing dispensing closure assembly 10 many times in a day. Exterior surface 81 provides a number of rounded projections 98 and an annular exterior gripping bead 99 to further assist a user in opening and closing dispensing closure assembly 10.

While the present invention has been shown and described in detail above, it will be clear to the person skilled in the art that changes and modifications may be made without departing from the spirit and scope of the invention. That which is set forth in the foregoing description and accompanying drawings is offered by way of illustration only and not as a limitation. The true scope of this invention is measured of course by the claims.

What is claimed is:

1. A dispensing closure assembly, comprising:

a cap attachable to an open end of a container, said cap including a first end in fluid communication with said open end of said container, a second end defining a sealable opening, and an elongate cap cavity extending therebetween for passage of fluid contents within said container through said cap; and an elongate hollow cover slidably movable with respect to said cap from a closed position restricting passage of said contents through said sealable opening of said cap to an open position permitting passage of said contents through said sealable opening of said cap;

wherein said cover includes a first end for sealing said sealable opening of said cap in the closed position and for permitting passage of said contents through said sealable opening in the open position, a second end including an annular cover surface defining a dispense opening of a first diameter therethrough for dispensing said contents in the open position, and an elongate passageway therebetween, said second end providing for one of direct dispensement of fluid therethrough and mating fluid communication with a luer cannula having a dispense opening of a second diameter smaller than said first diameter, said second end further defining an annular mitre channel spaced from said annular cover surface for providing a location at which said cover may be severed to define a dispense opening having a third diameter larger than said first diameter for direct dispensement of said contents.

2. The dispensing closure assembly of claim 1, wherein said annular miter channel extends in transverse coaxial alignment with said passageway.

3. The dispensing closure assembly of claim 1, wherein said cover includes a frangible closure tip in registry with said dispense opening; wherein said distal end of said cover may engage said luer cannula after said frangible closure has been removed.

4. The dispensing closure assembly of claim 3, wherein said cover sealably engages said cap proximal to and distal to said sealable openings of said cap.

5. The dispensing closure assembly of claim 4, wherein said cap provides wiping slidable engagement with said cover proximal to said sealable opening of said cap.

6. The dispensing closure assembly of claim 5, wherein said cap includes a depending annular sealing tooth for enhanced sealing engagement with and annular rim of the container.

7. The dispensing closure assembly of claim 6, wherein said cap includes a dispense valve portion having a tubular conduit wall and a co-axially located cylindrical hub connected to said conduit wall by three leg extents, whereby said leg extents define three sealable openings in sealable fluid communication with said dispense opening of said cover.

8. The dispensing closure assembly of claim 5, wherein said tubular conduit wall includes a first elongate cylindrical surface, a second cylindrical surface recessed from said first cylindrical surface, an annular stop bead, and a tapered annular skirt defining a cap dispense aperture.

9. The dispensing closure assembly of claim 8, wherein said annular skirt further includes a transversely-oriented planar valve seat defining said cap dispense aperture and said leg extents connect to said conduit wall interior of said planar valve seat.

10. The dispensing closure assembly of claim 9, wherein said cover further includes an elongate cylindrical cover bushing surface supporting an annular cover positioning rib at one end thereof, whereby the relative alignment of said cover positioning rib along said second cylindrical surface of said cap provides said open and closed positions for said dispensing closure assembly.

11. The dispensing closure assembly of claim 10, wherein said annular stop bead of said cap provides wiping sliding engagement with said cover bushing surface so as to prevent fluid from passing therebetween.

12. The dispensing closure assembly of claim 11, wherein said cover includes a planar seating surface for displaceable sealing engagement with said planar valve seat of said cap and a hub sealing surface for displaceable sealing engagement with said cylindrical hub in said closed position.

13. The dispensing closure assembly of claim 12, wherein said cover includes an exterior surface having a plurality of rounded projections and an annular exterior gripping bead to assist in opening and closing said dispensing closure assembly.

14. A kit for dispensing fluid from a container, comprising a dispensing closure assembly including a cap attachable to an open end of a container, said cap including a first end in fluid communication with said open end of said container, a second end defining a sealable opening, and an elongate cap cavity extending therebetween for passage of fluid contents within said container through said cap; and an elongate hollow cover slidably movable with respect to said cap from a closed position restricting passage of said contents through said sealable opening of said cap to an open position permitting passage of said contents through said sealable opening of said cap;

wherein said cover having a first end for sealing said sealable opening of said cap in the closed position and for permitting passage of said contents through said sealable opening in the open position, a second end for dispensing said contents therethrough in the open position, and an elongate passageway therebetween, said second end including an annular cover surface defining a dispense opening of a first diameter for one of direct dispensement of fluid therethrough and mating fluid communication with a luer cannula including a dispense opening of a second diameter smaller than said first diameter, said second end further defining an annular mitre channel spaced from said annular cover surface in transverse coaxial alignment with said passageway for providing a location at which said cover may be severed to define a dispense opening having a third diameter larger than said first diameter for direct dispensement of said contents; and a luer cannula adapted to be positionable over said annular cover surface.

15. A method of dispensing a fluid, comprising:

providing a dispensing closure assembly to an open end of a container of fluid, said dispensing closure assembly including a plurality of dedicatable dispense openings and a binary on-off adjustment by the user prior to each use for providing fluid communication between said container and one of said dedicatable dispense openings;

selecting one of said plurality of dedicatable dispense openings for dispensing said fluid therethrough; and adjusting said dispensing closure assembly to one of an open position so as to establish fluid communication between said container and said dispense opening and a closed position so as to prevent fluid communication between said container and said dispense opening subsequent to said selecting step.

16. The method of claim 15, wherein said selecting step further comprises the step of selecting a first dedicatable dispense opening defined by said dispensing closure assembly upon removal of a frangible closure tip.

17. The method of claim 16, wherein said selecting step further comprises one of the steps of cutting said dispensing closure assembly at a mitre channel formed in said dispensing closure assembly proximal to said first dispense opening so as to provide a dedicatable dispense opening larger than said first dedicatable dispense opening and positioning a luer-slip cannula over one end of said dispensing closure assembly so as to provide a dedicatable dispense opening larger than said first dedicatable dispense opening.

* * * * *